United States Patent [19]

Balkus

[11] Patent Number: 4,826,251

[45] Date of Patent: May 2, 1989

[54] DREDGING APPARATUS

[76] Inventor: Carl Balkus, 147 Deepwood Dr., Amston, Conn. 06231

[21] Appl. No.: 97,454

[22] Filed: Sep. 16, 1987

[51] Int. Cl.[4] ..... B03B 5/26; E02F 3/88; E02F 7/06

[52] U.S. Cl. ..... 299/7; 299/9; 299/18

[58] Field of Search ..... 299/7, 9, 18; 209/341, 209/458, 500

[56] References Cited

U.S. PATENT DOCUMENTS

| | | | |
|---|---|---|---|
| 1,611,255 | 12/1926 | Sturtevant | 209/341 |
| 1,719,442 | 7/1929 | Newsom | 299/9 |
| 2,174,925 | 10/1939 | McKeever | 209/458 X |
| 3,950,246 | 4/1976 | Klefisch | 299/9 X |
| 4,289,355 | 9/1981 | Rose | 299/9 |
| 4,360,424 | 11/1982 | Pearson et al. | 209/500 X |

*Primary Examiner*—Stephen J. Novosad

*Attorney, Agent, or Firm*—McCormick, Paulding & Huber

[57] ABSTRACT

A dredging platform has a water pump that creates suction in a hose for drawing loose materials from the bottom of a stream into the hose for transport to a sluice and vibratory screen. Larger stones are dropped off the end of the screen while finer sand and gold ore concentrate fall through the screen into hoppers for delivery to a centrifugal separator. The platform floats in the stream at water level to partially submerge the hoppers in order to provide a steady controlled flow of water over the hopper sides as the "fines" are collected for separation.

11 Claims, 3 Drawing Sheets

DREDGING APPARATUS

SUMMARY OF INVENTION

This invention relates generally to dredging apparatus and deals more particularly with a gold ore dredge especially suited for eliminating stones and boulders from the granular gravel and gold ore commonly separated in a centrifugal separator.

The general purpose of the present invention is to provide a dredging apparatus capable of separating granular gravel or sand, together with gold ore of similar consistency, from the relatively larger rocks and boulders that cannot be handled in a centrifugal separator.

In a typical state of the art centrifugal separator gold and gold concentrates are extracted from ore and gravel and other minerals with the aid of a rotating centrifugal tub into which water, gravel, and the ore are fed so that the heavier ore is trapped in portions of the tub and the excess water and gravel allowed to exit the separator.

One disadvantage of utilizing such a centrifugal separator for recovering fine gold is the fact that the streams where such ore and ore concentrates are found also include many rocks and boulders that cannot be handled in a centrifugal separator. The general purpose of the present invention is to provide an apparatus that facilitates dredging at the bottom of the stream so that these rocks and boulders and larger stones (greater than ⅜ inch in diameter) are separated from the "fines" that can be handled in a centrifugal separator of the type shown in my prior art U.S. Pat. No. 4,637,872.

In carrying out the present invention a platform is provided to carry all the necessary components for a dredging apparatus fitting the above delineated parameters. The platform preferably has buoyant devices provided for floatation to a predetermined water line and the platform is preferably secured in a stream or the like during operation thereof.

I provide means for pumping water from the stream through a pressure line that communicates with a suction hose to achieve a jet pumping action in the suction hose to suck loose sediment material from the bottom of the stream via the submerged end of the suction hose, and convey these materials upwardly onto the platform through a unique sluice means or nugget trap that impedes any larger heavy nuggets but allows the sediment to move downstream onto a generally rectangular screen.

The screen is adapted to pass only the "fines" and any stones and boulders move off an opposite end of the screen to be returned to the stream bottom.

Resilient means is provided for supporting the screen and means provided also for vibrating the screen to achieve a motion generally parallel to the plane of the screen itself.

The screen is provided above the water level and hopper means is provided below the screen so that all but the upper edges of the hopper means is submerged in the water surrounding the platform. Means is provided for collecting the granular gravel and gold ore from the hopper means, and a centrifugal separator is provided for processing these "fines" to separate gravel from the gold or gold ore.

The separator is preferably provided on the platform, but alternatively could be provided on the nearby bank of the stream itself. A collector conduit means is provided with water under pressure so as to entrain the "fines" from the lower region of the hopper below the water line of the platform and delivering these fines to the separator.

DETAILED DESCRIPTION

Figure 1:
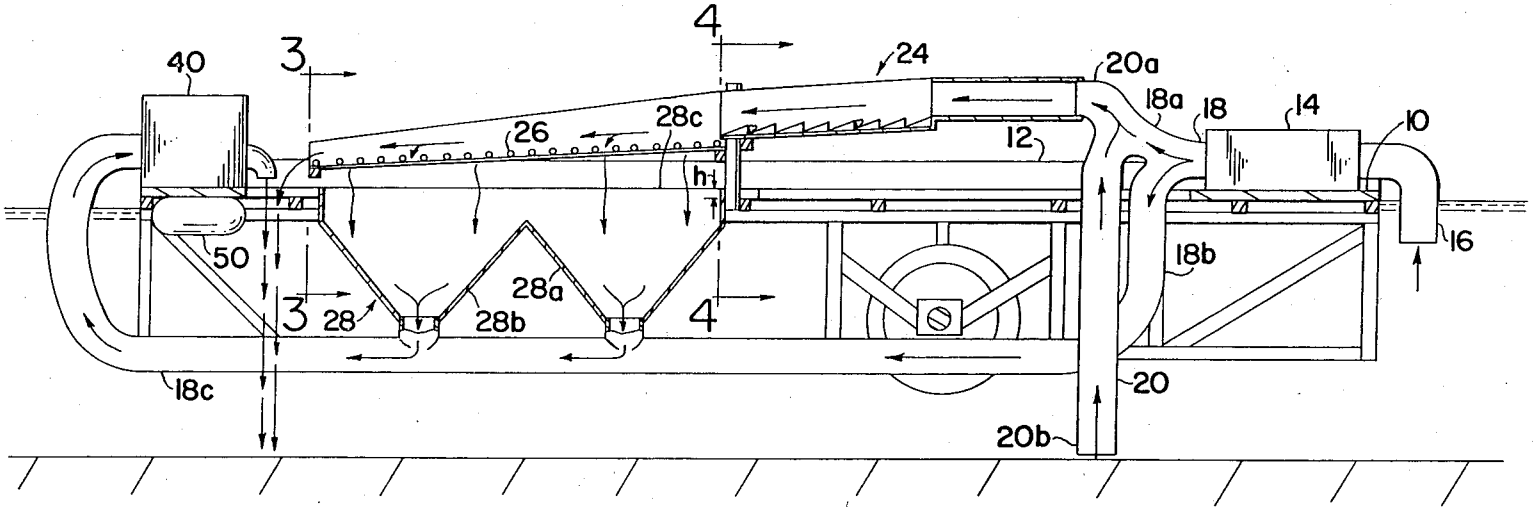
FIG. 1 is an elevational view of a dredging apparatus constructed in accordance with the present invention.
Figure 2:
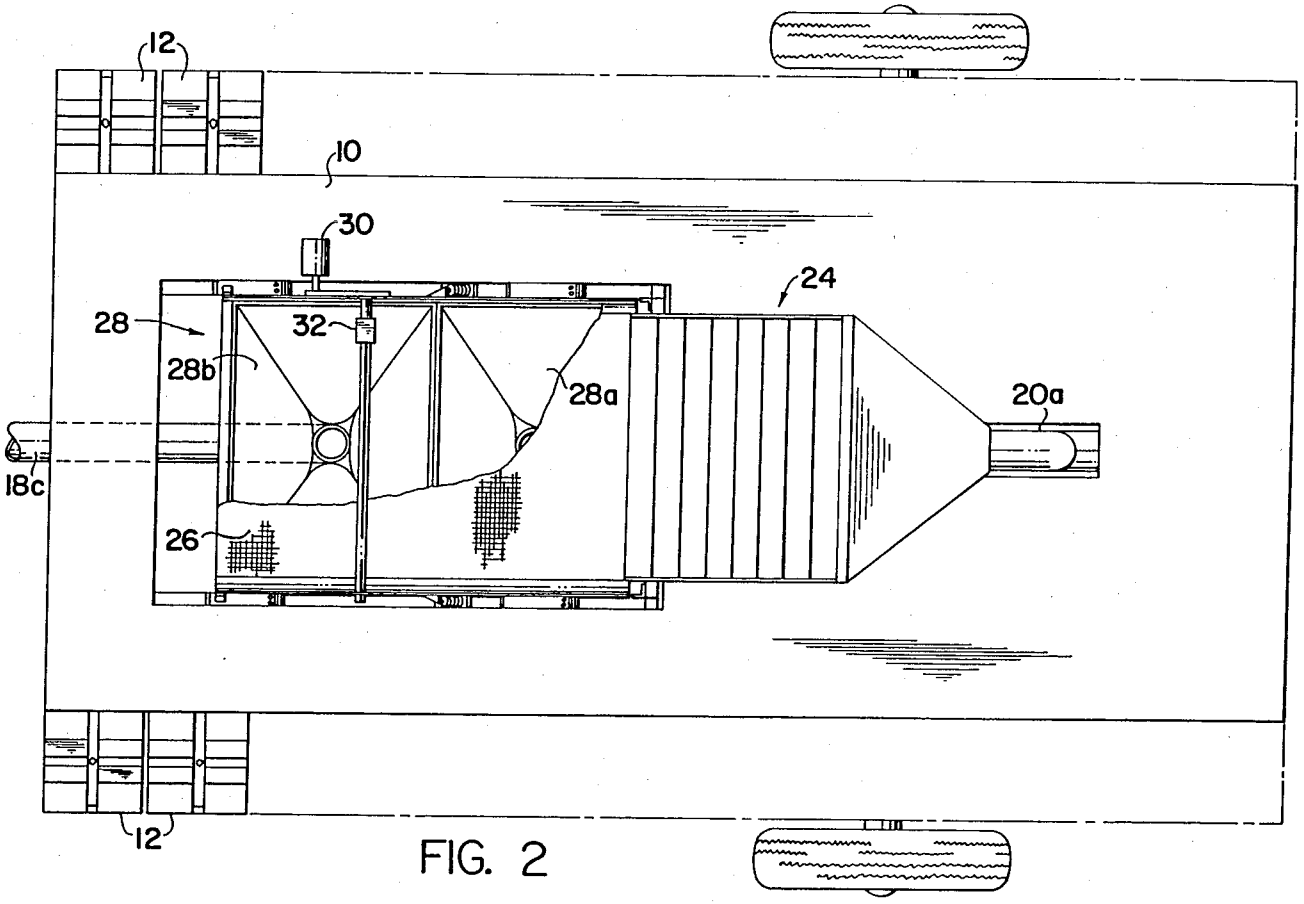
FIG. 2 is a plan view of a portion of the dredging apparatus illustrated in FIG. 1.
Figure 3:
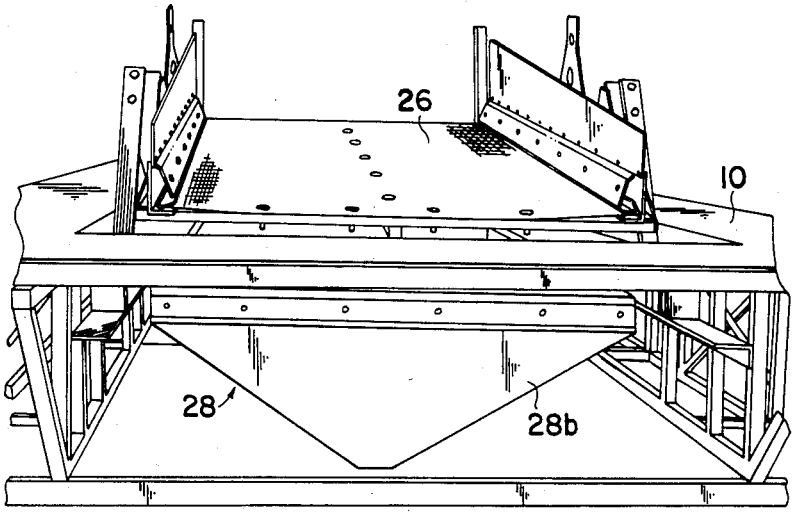
FIG. 3 is a vertical elevational view taken generally on the line 3—3 of FIG. 1.
Figure 4:
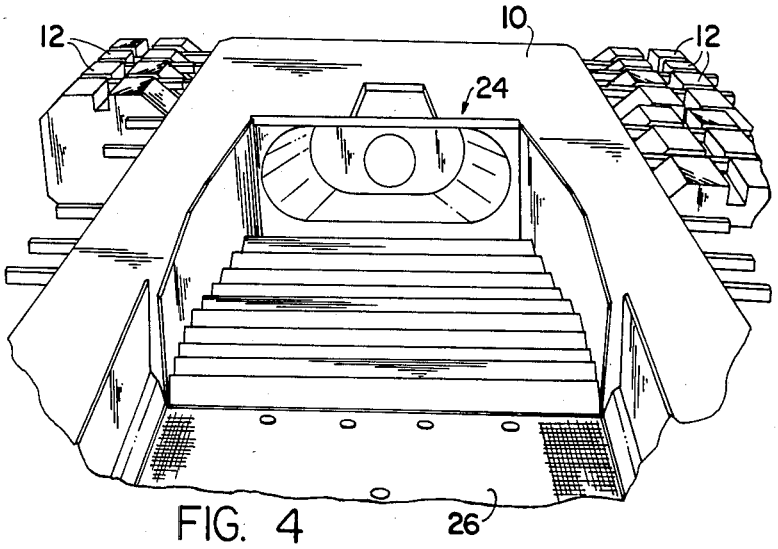
FIG. 4 is a view taken generally on the line 4—4 of FIG. 1.

Turning now to the drawings in greater detail, and referring more particularly to FIG. 1 a trailer platform 10 is provided with buoyant devices illustrated schematically at 12 in FIG. 1 and shown to better advantage in FIG. 4, such that the trailer is adapted to float in a stream or other body of water at a predetermined water level. The water line or water level is indicated schematically in FIG. 1. The trailer 10 may be constructed in a tubular truss configuration as suggested in FIGS. 3, 4 and 5 and may be equipped with two or more wheels for transporting the dredge platform to a particular site for its operation.

Pumping means is provided on the platform as indicated generally at 14 for drawing in water from the stream as shown by the line 16 and achieving a relatively high rate of water flow through the pump outlet conduit 18. The outlet conduit 18 has two branches **18*a* and 18*b* the first of which 18*a* serves to create a jet pump like action in a suction hose 20. One end of the suction hose is provide above the water line as indicated generally at 20*a* and the opposite end of the suction hose 20*b* is submerged where a diver manipulates the lower end of the suction hose to suction selected areas of the stream bottom providing sediment via the suction hose so that this sediment is deposited into sluice means 24 provided on the trailer platform 10**.

The sluice means 24 has an inlet end best shown in FIG. 4 adapted to be connected to said one end of the suction hose **20*a*, and the near end of the sluice means defines a shelf that is adapted to rest on a screen 26 to be described. The sluice means 24 preferably includes riffles extending laterally across its floor so as to stop the movement of relatively large heavy pieces of sediment drawn from the bottom of the stream where they can be examined by the dredge operating crew to be removed for inspection if the operator suspects the presence of a relatively large nugget. As the water and entrained sediment flow through the sluice 24 onto the screen 26 relatively large stones and or boulders will pass over the downstream end of the screen as suggested in FIG. 1** to be returned to the bottom of the stream.

In accordance with the present invention the screen 26 has a generally planar rectangular configuration with the longer sides being oriented parallel to the direction of flow for the water and sediment deposited thereon by the sluice means 24. Means is provided for vibrating the screen and preferably the screen is supported on four flexure legs that provide a resilient mounting means for the screen in order that the screen can be vibrated longitudinally in its own plane to achieve the desired direction of movement for the relatively large stones and boulders and to assure that the smaller granular gravel and gold ore are spread out on the screen to ultimately pass through openings in the screen where they are handled by hopper means to be described. Sides are provided for the screen so that these materials are restrained during this separation process.

Figure 5:
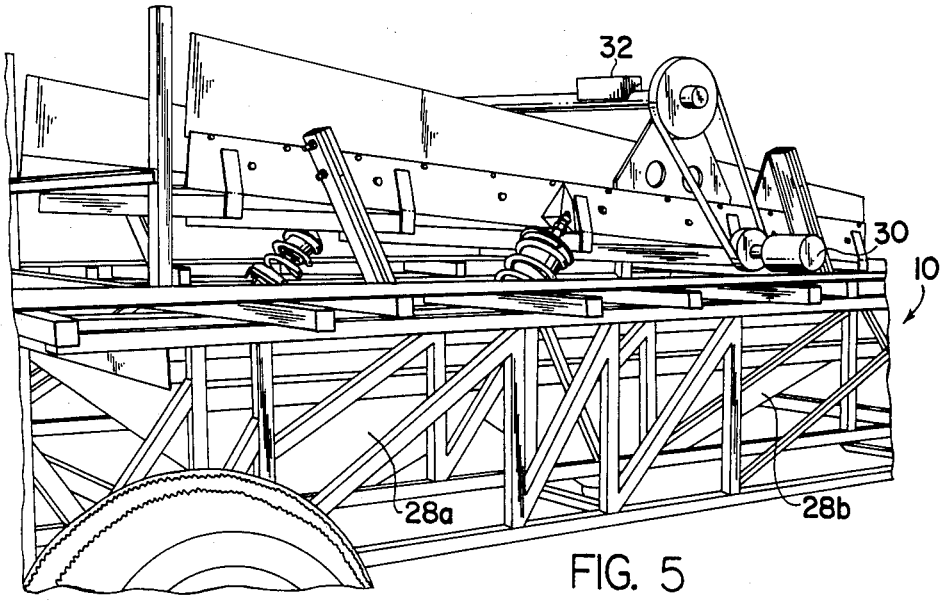
FIG. 5 is a rear quartering perspective view of the shaker screen and its resilient mounting together with the motor means and shaker means provided for vibrating the screen relative to the dredge platform.

The means for vibrating the screen comprises a hydraulic motor 30 mounted on the trailer platform as shown in FIG. 5. The motor operates a belt which in turn rotates a cross shaft carrying an eccentric weight 32 with the result that the unbalance of the rotating weight causes vibration of the screen which vibration is restricted to the generally parallel longitudinal motion defined by the plane of the screen itself. Four resilient flexure legs assisted by two shock absorbers provide restricted motion of the screen. The shock absorbers preferably have coil springs that are adjustable to achieve a desired degree of damping force on the vibratory screen motion.

Turning next to a description of the hopper means provided below the screen, FIG. 1 shows two chambers defined by two downwardly tapered hoppers that terminate in connections where the lower hopper openings communicate with the conduit leg **18*b* associated with the pressure or outlet side of the pump 14. Thus, water under pressure flows through conduit 18*b* and carries away the fines provided to it through the openings in the lower portions of the two hoppers 28*a* and 28*b*. The hopper means 28 is preferably coextensive in planform size and shape to that of the generally rectangular screen 26 with the result that material falling through the screen 26 will necessarily be trapped by the hopper means to be ultimately delivered through conduit line 18*b* to a centrifugal separator such as that indicated generally at 40 in FIG. 1. It is an important feature of the present invention that said hopper means 28 have a peripherally extending upper marginal edge provided above the water line to permit water to fill the hopper means to a level (h) above that of the water in the stream. Thus, water overflows from the hopper means at a predetermined rate so as to assure that the fines remain within the hoppers to be carried away by the pressurized water flow in conduit 18*b***.

The pressurized water flow in line **18*b* creates a jet pumping action at the bottom of both hoppers to entrain the slurry from the hopper means in the line 18*c*. These materials are then carried to the centrifugal separator 40. As mentioned previously the separator 40 can be provided either on the platform 10 as shown in FIG. 1 or alternatively might instead be provided on the bank of the stream or at some other suitable location. It is important to provide means for leveling the platform 10 thereby assuring that the water level relative to the hoppers remain in a predetermined relationship. Suitable means, indicated generally at 50 in FIG. 1, serves to provide a degree of control over the floatation of the platform to the end that the upper edge 28*c* of the hoppers 28*a* and 28*b*** is held to this predetermined level (h).

The disclosure in U.S. Pat. No. 4,637,872 is incorporated by reference herein to the extent that applicant has in this application claimed the separator in combination with the dredging apparatus described above.

I claim:

1. A gold ore dredge for eliminating stones from granular gravel and ore such as can be accommodated in a centrifugal separator, said dredge comprising:

a platform having buoyant devices provided for floatation of the platform to a predetermined water line in a stream or the like, means for pumping water and including an outlet providing water under pressure, a generally flat planar screen with openings to pass said granular gravel and gold ore, resilient means mounting said screen to said platform so that movement of said screen is restricted generally to parallel orbital movement in the plane of the screen, means for vibrating said screen to achieve said orbital screen movement, hopper means mounted in said platform below said vibrating screen, a suction hose with one end provided adjacent said screen, conduit means with one end connected to said pumping means outlet and another end communicating with said suction hose to provide water flow toward said one end of said suction hose and to provide a water jet pumping action at the other end of said suction hose for drawing water and sediment from the bottom of the stream into said suction hose for delivery to said screen, said screen movement causing the sediment to move across the screen so that granular gravel and gold ore passing downwardly through said screen and larger stones stay on the screen until reaching a screen position where they drop off the screen for return to the stream, means for collecting of the granular gravel and gold ore from said hopper means, said screen being inclined relative to the horizontal and spaced above the water line of said platform, and said hopper means provided below the water line of said platform, said hopper means having an upper marginal edge extending at least around the major portion of said hopper means, said peripherally extending upper marginal edge provided above said platform water line to allow said hopper means to operate full of water and entrained granular gravel and gold ore and so that water spills over said upper edge.

2. The combination according to claim 1 wherein said screen is of generally rectangular planform with mutually perpendicular longer and shorter sides, one shorter side being provided adjacent said one end of said suction hose and said other side of said screen adjacent said screen position where the stones drop back into the stream.

3. The combination according to claim 2 wherein said hopper means is also generally retangular and said hopper means having its longer sides with upper marginal edges located at least slightly above the stream's water level so that said hopper means contains water entrained granular gravel and gold ore to a level above that of the stream's water level in order to create a slight but controlled overflow effect in said hopper means.

4. The combination of claim 3 further including leveling means for achieving a predetermined height for said hopper means relative to said platform water line.

5. The combination of claim 2 further characterized by sluice means between said one shorter screen side and said one end of said suction hose to trap nuggets and yet allow for the sediment material to move onto said screen.

6. The combination according to claim 1 further characterized by sluice means between said one end of said suction hose and said screen, said sluice means comprising; an inlet end connected to said suction hose an outlet end defining a shelf overlapping said flat screen, and an intermediate portion of said sluice means defining an upwardly open channel with a floor that defines said outlet end shelf, said floor and shelf having riffles for impeding the flow of stones and stone sized gold nuggets.

7. The combination according to claim 1 wherein said means for vibrating said screen comprises a rotatably supported eccentric weight provided on said screen, motor means on said platform for rotating said weight, and coupling means between said rotatably supported weight and said motor means.

8. A gold ore dredge for eliminating stones from granular gravel and ore such as can be accommodated in a centrifugal separator, said dredge comprising:

a platform having buoyant devices provided for flotation of the platform to a predetermined water line in a stream or the like, means for pumping water and including an outlet providing water under pressure, a generally flat planar screen with openings to pass said granular gravel and gold ore, resilient means mounting said screen to said platform so that movement of said screen is restricted generally to parallel orbital movement in the plane of the screen, means for vibrating said screen to achieve said parallel screen movement, hopper means mounted in said platform below said vibrating screen, a suction hose with one end provided adjacent said screen, conduit means with one end connected to said pumping means outlet and another end communicating with said suction hose to provide water flow toward said one end of said suction hose and to provide a water jet pumping action at the other end of said suction hose for drawing water and sediment from the bottom of the stream into said suction hose for delivery to said screen, said screen movement causing the sediment to move across the screen so that granular gravel and gold ore passing downwardly through said screen and larger stones stay on the screen until reaching a screen position where they drop off the screen for return to the stream, and means for collecting of the granular gravel and gold ore from said hopper means, centrifugal separator means for processing the granular gravel and gold ore to separate gravel from the gold ore.

9. A gold ore dredge for eliminating stones from granular gravel and ore such as can be accommodated in a centrifugal separator, said dredge comprising:

a platform having buoyant devices provided for flotation of the platform to a predetermined water line in a stream or the like, means for pumping water and including an outlet providing water under pressure, a generally flat planar screen with openings to pass said granular gravel and gold ore, resilient means mounting said screen to said platform so that movement of said screen is restricted generally to parallel orbital movement in the plane of the screen, means for vibrating said screen to achieve said parallel screen movement, hopper means mounted in said platform below said vibrating screen, a suction hose with one end provided adjacent said screen, conduit means with one end connected to said pumping means outlet and another end communicating with said suction hose to provide water flow toward said one end of said suction hose and to provide a water jet pumping action at the other end of said suction hose for drawing water and sediment from the bottom of the stream into said suction hose for delivery to said screen, said screen movement causing the sediment to move across the screen so that granular gravel and gold ore passing downwardly through said screen and larger stones stay on the screen until reaching a screen position where they drop off the screen for return to the stream, and means for collecting of the granular gravel and gold ore from said hopper means, said means for collecting the granular gravel and gold ore also includes collector conduit means with one end connected to said first mentioned conduit means and said pumping means outlet, said collector conduit means having an opposite end and an intermediate portion for collecting the granular gravel and gold ore, said opposite end providing the granular gravel and gold ore to said separator.

10. The combination according to claim 8 wherein said resilient means mounting said screen to said platform comprise flexures provided adjacent one and an opposite end of said screen, said screen being of generally rectangular planform, one side of said screen provided adjacent said one end of said suction hose and said other side of said screen adjacent said screen position where the stones drop back into the stream.

11. The combination according to claim 10 wherein said hopper means is also generally retangular and said hopper means having its longer sides with upper marginal edges located at least slightly above the stream's water level so that said hopper means contains water entrained granular gravel and gold ore to a level above that of the stream's water level in order to create a slight overflow effect in said hopper means.

* * * * *